United States Patent [19]

Dance

[11] Patent Number: 4,938,916

[45] Date of Patent: Jul. 3, 1990

[54] FLUX ENHANCEMENT FOR NEUTRON RADIOGRAPHY INSPECTION DEVICE

[75] Inventor: William E. Dance, Dallas, Tex.

[73] Assignee: LTV Aerospace and Defense Co., Dallas, Tex.

[21] Appl. No.: 837,548

[22] Filed: Mar. 7, 1986

Related U.S. Application Data

[63] Continuation-in-part of Ser. No. 449,391, Dec. 13, 1982, abandoned.

[51] Int. Cl.[5] ..... G21K 5/00

[52] U.S. Cl. ..... 376/110; 250/251; 250/391; 376/114

[58] Field of Search ..... 250/251, 390 R, 391, 250/518.1; 376/108, 110, 114, 190, 199

[56] References Cited

U.S. PATENT DOCUMENTS

| | | | |
|---|---|---|---|
| 3,558,890 | 1/1971 | Yanagishita et al. | 250/108 |
| 3,914,612 | 10/1975 | Cason, Jr. et al. | 250/499 |
| 4,152,598 | 5/1979 | Stewart | 250/391 |
| 4,192,998 | 3/1980 | Azam | 376/190 |
| 4,300,054 | 11/1981 | Dance et al. | 376/190 |
| 4,582,999 | 4/1986 | Dance et al. | 250/518.1 |
| 4,830,813 | 5/1989 | Dance . | |

OTHER PUBLICATIONS

Spowart, "Use of a $10^{11}$ n/sec Neutron Generator for Neutron Radiography," *Nuc. Instru. & Methods*, vol. 92, No. 4, pp. 613–617, 1971.

*Primary Examiner*—Deborah L. Kyle
*Assistant Examiner*—Richard W. Wendtland
*Attorney, Agent, or Firm*—Charles S. Cotropia; James M. Cate

[57] ABSTRACT

A neutron radiography system having a high energy neutron generator (100) of the type comprising an ion accelerator (106) and a tritium target (110) located downstream of the accelerator. The generator is disclosed in a housing (22) containing a moderator medium (140) adapted to absorb part of the energy of the neutrons, thereby creating thermal neutrons. A neutron flux booster (130) comprised of a high neutron cross section material, such as depleted uranium, is disposed between the target and the moderator medium such that collisions of high energy neutrons produced at the target will collide with the uranium to release additional high energy neutrons from the booster into the moderator medium. A collimator (40) is disposed in communication with the moderator material for discharging thermal neutrons from the moderator medium.

11 Claims, 3 Drawing Sheets

FLUX ENHANCEMENT FOR NEUTRON RADIOGRAPHY INSPECTION DEVICE

RELATED APPLICATION

This application is a continuation-in-part of U.S. Pat. Application Ser. No. 449,391, filed Dec. 13, 1982 and entitled Flux Enhancement For Neutron Radiography Inspection Device now abandoned.

TECHNICAL FIELD

This invention relates to neutron radiography and more particularly to apparatus and methods for enhancing the thermal neutron flux in neutron radiography inspection devices.

BACKGROUND ART

Neutron ray generators have been developed for a variety of uses. Most conventional neutron generator systems are employed in the technique of neutron activation analysis in which high speed (fast) neutrons generated by directing an ion beam in an accelerator tube are directed at a suitable target which then emits high energy neutrons. The composition of the test material irradiated with high energy neutrons is determined by analyzing the emissions from the test material.

In other applications, such as neutron radiography high energy (fast) neutrons are not suitable, and such fast neutrons must be reduced to low energy (thermal) neutrons by discharging a high energy neutron beam into a suitable moderator medium.

A neutron radiography inspection device employing an ion accelerator system is disclosed in the copending application Ser. No. 483,847 of William E. Dance, filed April 13, 1983, entitled THERMAL NEUTRON COLLIMATOR. The inspection device includes a housing containing a moderator material with a high energy neutron source positioned therein. A collimator mounted in the housing discharges a beam of thermal neutrons issuing from the moderator material as the result of bombardment of hydrogen protons in the moderator material with high energy neutrons emitted from an ion accelerator tube.

Although ion accelerator neutron radiography row systems compare favorably with radiography systems using neutron emitting isotopes, radiographs produced by ion accelerator systems had not prior to systems of the type described in invention disclosures by W.E. Dance been of the same quality and resolution as in systems using neutron emitting isotopes. However, ion accelerator systems have significant advantages over the isotope systems. They are less costly, have on/off capability and are useful in portable neutron radiography applications, where the weight of the shielding required for large isotope systems is prohibitive in a portable system. Thus, in portable systems, ion accelerator systems are preferred.

Since the radiograph exposure time is inversely related to the magnitude of the thermal neutron flux, inspection operations with portable neutron radiography systems using ion accelerator systems could become much more efficient if the thermal neutron flux of these systems could be increased.

DISCLOSURE OF THE INVENTION

The specification discloses an improvement for an apparatus for producing thermal neutron radiographs. Such apparatus typically contains a high energy neutron generator comprising an ion accelerator and a tritium target located downstream of the accelerator for producing a stream of high energy neutrons having an energy of about 14 MeV. Neutrons produced at the target are discharged into a moderator medium disposed between the inlet end of the collimator and the target for thermalizing high energy neutrons. A collimator, having its inlet end disposed in the moderator material, is provided for collecting thermalized neutrons. The improvement comprises a neutron flux booster containing material having a high neutron cross section, such that high energy neutrons produced at the target will undergo collisions with the material to release additional high energy neutrons although with lower energy from the material. The booster, disposed proximate to the ion accelerator, contains a cavity formed therein adapted to seat the tritium target within the material such that the high neutron cross section material is disposed between the target and the moderator medium. The material has sufficient thickness such that substantially all neutrons produced at the target will undergo at least one collision with the high neutron cross section material and the material has sufficient thinness such that additional neutrons released from the material are not substantially absorbed.

According to another aspect of the present invention, a method is disclosed for increasing the neutron flux produced by a neutron generator of the type having an ion accelerator and a target located downstream of the accelerator. A stream of high energy neutrons produced at the target is directed into a quantity of high neutron cross section material whereby neutrons from the target undergo collisions with the material to release additional high energy neutrons in the material. High energy neutrons released from the material are then subjected to a moderator medium whereby part of the energy of the neutrons is absorbed, thereby creating a source of thermal neutrons. The thickness of the material is sufficient to permit substantially all neutrons produced at the target to undergo at least one collision with the material, yet the material is sufficiently thin to prevent substantial absorption of additional neutrons released from the material.

According to yet another embodiment of the invention, a neutron radiography system is disclosed. A high energy neutron generator comprises an ion accelerator and a target located downstream of the accelerator to produce a stream of incident neutrons having an energy of about 14 MeV. A moderator material is provided proximate the generator whereby part of the energy of high energy neutrons are absorbed, thereby creating a source of thermal neutrons. A neutron flux booster surrounding the target is disposed between the target and the moderator medium. The booster contains a material having a high neutron cross section such that collisions of high energy neutrons produced at the target with the material release additional high energy neutrons with lesser energy in the material. The material has sufficient thickness such that neutrons produced at the target will undergo at least one collision, and the material has sufficient thinness such that additional high energy neutrons released from the material will not be completely absorbed by the material. A collimator having a neutron-permeable inlet end is disposed in communication with the moderator material for discharging thermal neutrons produced in the moderator medium.

According to yet another embodiment of the present invention, an improved neutron radiography system is disclosed. Two high energy neutron generators of the type having an ion accelerator and a target are disposed within a housing containing a moderator or medium for absorbing part of the energy of the neutrons, thereby providing thermal neutrons. A neutron flux booster, composed of high neutron cross section material, is provided between each target and the moderator medium such that collisions between the high energy neutrons produced at the target and the high neutron cross section material release additional high energy neutrons into the moderator material.

BRIEF DESCRIPTION OF THE DRAWINGS

For a more complete understanding of the present invention, and for further details and advantages thereof, reference is now made to the following Detailed Description taken in conjunction with the accompanying Drawings, in which.

DETAILED DESCRIPTION

Figure 1:
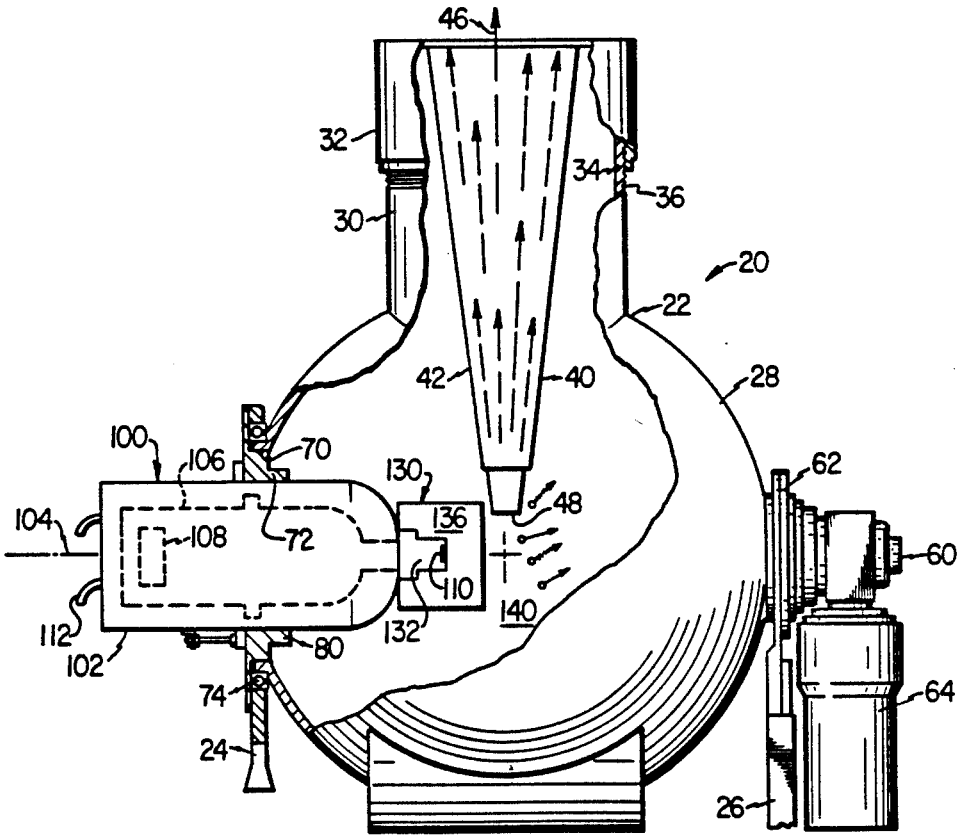
FIG. 1 is a partially broken away plan view of the neutron radiography inspection device of one embodiment of the present invention.

Referring to FIG. 1, neutron radiography inspection device 20 is illustrated in a partially broken away plan view. Inspection device 20 includes an inspection head 22 pivotally supported from support arms 24 and 26. Head 22 includes a spherical housing 28 with a cylindrical collimator support housing 30 extending therefrom. A cap 32 is threadedly engaged on the end of collimator support housing 30. Cap 32 has internal threads 34 which mate with threads 36 on the exterior of support housing 30. A collimator 40 is attached to cap 32 at the uppermost end as seen in FIG. 1.

Collimator 40 includes a generally rectangular hollow tube having four side walls 42 and a bottom wall with an inlet window 48. Collimator 40 has a longitudinal axis 46. As is seen in FIG. 1, side walls 42 diverge at a constant rate in the downstream direction of the tube from window 48. Window 48 includes a neutron permeable material which acts as an inlet window for the thermal neutrons. At its diverging end, the collimator tube is open to form an outlet for the collimator thermal neutron beam. For further details concerning the construction and dimensions of the collimator 40, reference is made to my copending application Ser. No. 483,847, entitled, THERMAL NEUTRON COLLIMATOR, filed April 13, 1983.

Inspection head 22 is supported on one side by arm 26 by the journaling of shaft 60 extending from head 22 through an appropriate bearing structure 62. A drive motor 64 is also mounted for turning shaft 60 to rotate inspection head 22.

An opening 70 is provided in head 22 and is coaxially aligned with shaft 60 in the opposite side of the housing from shaft 60. Upon activation of drive motor 64, head 22 is rotated about its horizontal axis on support bearings 74 and bearing structure 62.

A relatively large opening is defined by flange 72 concentric with the rotational axis of the housing. An annular flange hub 80 is attached to support arm 24 by appropriate bolts and is fitted within the opening. A neutron generator 100 having an elongated housing 102 is mounted with its longitudinal axis 104 coincident with the axis of rotation of inspection head 22. Housing 102 contains an elongated evacuation tube 106 having a positive ion source 108 near one end thereof and an appropriate target 110, such as a tritium target, downstream thereof. Upon bombardment by ions generated in tube 106, the target emits high energy neutrons.

Although various types of neutron sources may be employed in thermal neutron radiography applications, an on/off switchable ion source is desirable particularly in portable operations because of the hazards of conventional continuous radioisotopic sources. Illustrative of generators of the on/off type is the sealed tube 14 MeV neutron generator such as Model A-711 manufactured by Kaman Sciences Corporation. This neutron generator comprises an elongated cylindrical housing with a target at one end and a plurality of high voltage inputs 112 at the opposite end. Voltages can thereby be selectively applied to the accelerator tube to generate 14 MeV fast neutrons when desired.

Figure 2:
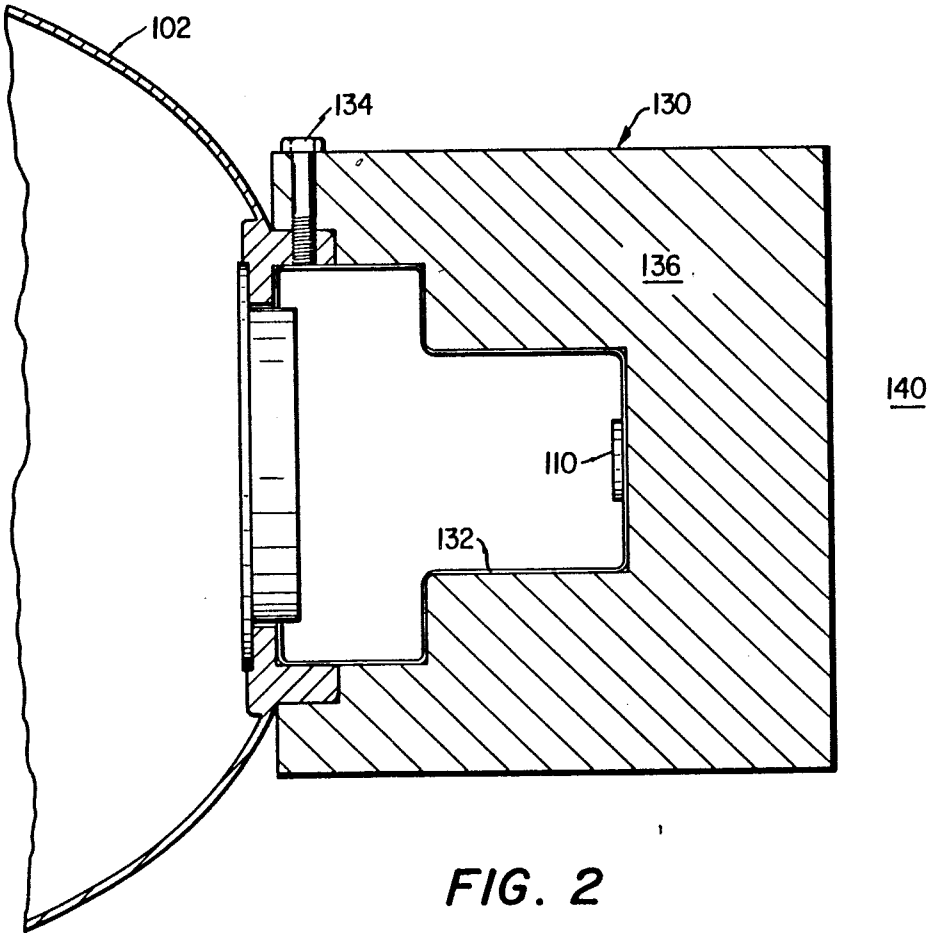
FIG. 2 is an enlarged section view of the neutron generator and booster assembly shown in FIG. 1.

Referring now to both FIGS. 1 and 2, evacuation tube 106 in housing 102 discharges high energy (fast) neutrons into a neutron flux booster 130, which has a cavity 132 formed therein to receive a tritium target 110, as shown in FIGS. 1 and 2. Neutron flux booster 130 is mechanically connected to housing 102 by bolting means 134. Booster 130 is formed of a material 136 having a high neutron cross section, such that each interaction between an incident neutron and the material may give off one or more neutrons. The dimensional characteristics of material 136 are chosen to facilitate second, third and even higher orders of collisions within the material. The material must be thick enough such that all 14 MeV neutrons leaving the target will undergo at least one collision in the shield, yet thin enough that the multiplication factor is not significantly reduced by absorption. The thickness of material 136 adjacent target 110 in cavity 132 is in the range of about one inch to about three inches and is substantially uniform in thickness. Multiplication factors of up to about 5 appear to be possible in some materials, although this factor would be reduced by absorption in the material. Thus, the net number of neutrons exiting from the flux booster is the number of neutrons entering the booster plus the number resulting from multiplication in the booster minus the number absorbed in the booster material.

Depleted uranium ($^{238}U$) is a suitable material for use in the flux booster because of its relative safety, exemption from regulatory licenses and high neutron cross section. Since depleted uranium is a biologically safe material and relatively free from licensing restrictions provided parts are obtained from a licensed manufacturer, it is appropriate for use in relatively lightweight, portable radiography systems, such as in the present invention. Using a Kaman A-711 neutron generator, the neutron flux booster makes it possible to achieve an effective radiography system weighing only about seven tons, the equivalent neutron flux which would otherwise be achieved only in a 17-ton system using other available neutron generators.

The neutrons exiting from the flux booster 130 have energies ranging from about 1.3 MeV to about 15 MeV, depending upon the number of interactions these neutrons have undergone. The 14 MeV high energy (fast) neutrons emitted by target 110 and multiplied by the flux booster 130 are not suitable for thermal neutron radiography. Accordingly, the energy must be reduced by suitable moderation to provide lower energy thermal neutrons. Fast neutrons are moderated by submerging the flux booster 130 in a moderator fluid such as water or a suitable organic fluid such as high purity transformer or mineral oil. Accordingly, inspection head 22 is filled with a suitable moderator fluid 140. The high energy neutrons emitted by the flux booster 130 collide with the hydrogen protons in the moderator fluid giving up energy as they diffuse through the fluid. The radius of the spherical body 28 is determined by the energy of the fast neutrons admitted into the moderator fluid and the volumnar displacement of the fluid by the flux booster 130 such that the high energy neutrons emitted from the flux booster 130 will be effectively moderated or thermalized by multiple collisions by the time they diffuse to the inlet window 48 of the collimator 40.

The use of a depleted uranium booster material increases the ultimate collimated neutron beam by multiplication through fission and the second and third order reactions in the depleted material before thermalization, and by more efficient moderation of the lower energy second and third order reaction neutrons, with no increase in power consumed.

Figure 3:
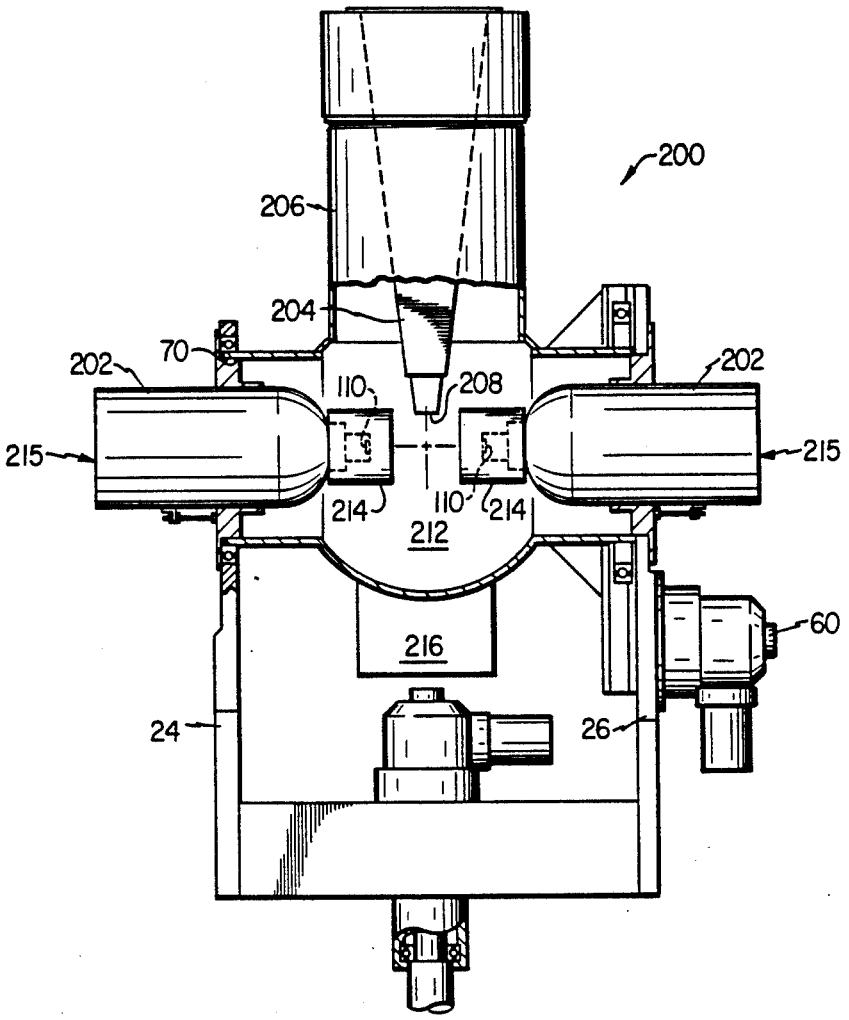
FIG. 3 is a section view of the neutron radiography inspection device of a second embodiment of the present invention employing dual neutron generators.

FIG. 3 illustrates a second embodiment of the invention in which a neutron radiography inspection device employing dual neutron generators is illustrated. Inspection device 200 employs dual neutron generators 202, such as the Kaman A-711 type, with tritium targets 110. Collimator 204 is mounted in collimator housing 206 substantially as described in connection with the first embodiment of the invention. Collimator 204 contains the neutron permeable inlet window 208, which is disposed in the moderator fluid 212. Neutron generators 202 are preferably used in connection with neutron flux boosters 214, as previously described, although it will be understood that dual generators 202 could also be used without the neutron flux boosters. A counterweight 216 may be required to balance the system collimator. In all other respects, the embodiment shown in FIG. 3 is substantially the same as the first embodiment of the invention illustrated in FIG. 1. In the configuration illustrated in FIG. 3, the axes 215 of generators 202 are coextensive. Although a 180° orientation of generators 202 is clearly preferred, it will be understood that different relative angular positions of the two generators are possible depending upon the particular application.

When a second neutron generator tube 202 together with a flux booster 214 is inserted into the moderator fluid 212, the resulting neutron flux is increased by a factor of 2 less the losses which occur due to perturbation of the thermal neutron field in the moderator from insertion of the second generator tube. Conservative estimates of the multiplication and thermalization factors in a two tube booster assemblies indicate an output flux in excess of $5\times10^5$ n/cm$^2$ sec may be achieved. By effectively doubling the neutron flux output with the use of a second generator tube, the exposure time required per radiograph is effectively reduced by half, thereby almost doubling the potential rate of inspection. These benefits are achieved with minimal increase in system rate, size and minimal increase in radiation levels.

The use of two Kaman A-711 neutron generators offers significant advantages over the use of a single larger source of neutrons. In the system shown in FIG. 3, with the addition of a second neutron generator, the combined weight of two Kama A-711 generator tubes is only 70 pounds, compared with a minimum of 330 pounds for the next lowest weight available system with comparable neutron output. The combined power supplies and cooling units required by the system in FIG. 3 weigh approximately 2,600 pounds, compared with 18,000 pounds for the next lowest weight system.

The dual generator system shown in FIG. 3 offers a desirable redundancy for maximum reliability of system operation. Operation at a reduced level is a practical alternative for many inspection tasks in the event of neutron generator source failure. Moreover, the dual source geometry contributes to high collimator beam uniformity. By using the dual Kaman sources with the neutron flux boosters, the source weight is only 1/7 that of any other source available. This provides the needed assurance that the total system will be compact, easily managed and useful.

Although preferred embodiments of the invention have been described in the foregoing Detailed Description and illustrated in the accompanying Drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the inventibn.

I claim:

1. In an apparatus for producing thermal neutron radiographs having a high energy neutron generator comprising an ion accelerator and a target located downstream of the accelerator, the generator having an aperture through which ions are directed against said target for emitting fast neutrons from said target, a collimator for collecting thermal neutrons and a moderator medium disposed between the inlet end of the collimator and the target for thermalizing high energy neutrons produced at the target, the improvement comprising:

a neutron flux booster having an inlet, said inlet having a size greater than the generator aperture and being positioned adjacent to the generator aperture to thereby surround the generator aperture, said booster further including a cavity formed therein for receiving the target, said cavity having an opening spaced apart from said booster inlet and being aligned with said booster inlet and further being aligned with said generator aperture, the target being positioned within said cavity and spaced apart from said cavity opening, said cavity having a depth substantially greater than the thickness of the target such that the booster completely encircles the target except for the cavity opening facing the generator, said booster comprising material having a high neutron cross section such that neutrons produced at said target will undergo collisions with said material to release additional high energy neutrons from said material, said booster disposed between said target and said moderator medium.

2. The improvement of claim 1 wherein said high neutron cross section material is depleted uranium.

3. The improvement of claim 1 wherein said material has a thickness in the range from about one inch to about three inches.

4. In an apparatus for producing thermal neutron radiographs having a high energy neutron generator comprising an ion accelerator and a tritium target located downstream of the accelerator, the generator having an aperture through which ions are directed against said target for emitting fast neutrons from said target, a collimator for collecting thermal neutrons and a moderator medium disposed between the inlet end of the collimator and the target for thermalizing high energy neutrons produced at the target, the improvement comprising:

a neutron flux booster comprising material having a high neutron cross section such that high energy neutrons produced at said target will undergo collisions with said material to release high energy neutrons from said material, said booster disposed adjacent said ion accelerator and having an inlet, said inlet having a size greater than the generator aperture and being positioned adjacent to the generator aperture to thereby surround the generator aperture, said booster further including a cavity formed therein for receiving the target, said cavity having an opening spaced apart from said booster inlet and being aligned with said booster inlet and further being aligned with said generator aperture, the target being positioned within said cavity and spaced apart from said cavity opening, said cavity having a depth substantially greater than the thickness of the target such that the booster completely encircles the target except for the cavity opening facing the generator;

said high neutron cross section material being disposed between the target and the moderator medium; and said material having sufficient thickness in the range of about three inches such that substantially all neutrons produced at said target will undergo at least one collision in said material and said material having sufficient thinness in the range of about one inch such that additional neutrons released from said material are not substantially absorbed.

5. A neutron radiography system comprising:

a high energy neutron generator comprising an ion accelerator and a target located downstream of said accelerator for producing a stream of high energy neutrons, said generator having an aperture through which ions are directed against said target for emitting fast neutrons from said target;

a moderator medium disposed around said target, said material adapted to absorb part of the energy of said neutrons, thereby providing thermalized neutrons;

a neutron flux booster disposed between said target and said moderator medium, and having an inlet, said inlet having a size greater than the generator aperture and being positioned adjacent to the generator aperture to thereby surround the generator aperture, said booster further including a cavity formed therein for receiving the target, said cavity having an opening spaced apart from said booster inlet and being aligned with said booster inlet and further being aligned with said generator aperture, the target being positioned within said cavity and spaced apart from said cavity opening, said cavity having a depth substantially greater than the thickness of the target such that the booster completely encircles the target except for the cavity opening facing the generator, said booster having a high neutron cross section such that collisions of neutrons with said material release additional high energy neutrons in said material;

said booster dimensioned to have sufficient thickness in the range of about three inches, such that substantially all high energy neutrons produced from said target will undergo at least one collision with said material;

said booster dimensioned to have sufficient thinness in the range of about one inch, such that additional high energy neutrons released in said material are not substantially absorbed by said material; and a collimator disposed in communication with said moderator material for discharging thermal neutrons from said moderator medium.

6. The system of claim 5 wherein said neutron flux booster is comprised of depleted uranium.

7. A portable neutron radiography system comprising:

a first high energy neutron generator comprising a first ion accelerator and a first target located downstream of said accelerator for producing a first stream of fast neutrons, said first generator having an aperture through which ions are directed against said target for emitting, said first stream of fast neutrons from said first target;

a second high energy neutron generator having a second ion accelerator and a second target substantially identical to said first generator for producing a second stream of fast neutrons, said second generator having an aperture through which ions are directed against said target, for emitting said second stream of fast neutrons from said second target;

a moderator medium disposed adjacent said first and said second targets such that said first and second streams of high energy neutrons are discharged into said medium, said medium adapted to absorb part of the energy of said neutrons, thereby creating thermalized neutrons;

a pair of neutron flux boosters disposed between each of said targets and said moderator medium, each of said boosters having an inlet, said inlet having a size greater than the generator aperture and being positioned adjacent to the generator aperture to thereby surround the generator aperture, said booster further including a cavity formed therein for receiving the target, said cavity having an opening spaced apart from said booster inlet and being aligned with said booster inlet and further being aligned with said generator aperture, the target being positioned within said cavity and spaced apart from said cavity opening, said cavity having a depth substantially greater than the thickness of the target such that the booster completely encircles the target except for the cavity opening facing the generator, said booster having a high neutron cross section such that collisions of neutrons with said material release additional high energy neutrons in said material;

a collimator communicating with said moderator medium for discharging thermal neutrons;

wherein said first and second generators and said collimator are disposed within a housing containing said moderator medium; and wherein the angle between said first and said second streams of high energy neutrons is about 180 and wherein the axis of the collimator is positioned between said first and second generators and the angle between the axis of said collimator and said first stream of neutrons is about 90.

8. The portable system of claim 7 wherein said material has a thickness in the range from about one inch to about three inches.

9. A method for increasing the neutron flux produced by a neutron generator of the type comprising an ion accelerator and a target located downstream of the accelerator and having an aperture through which ions are directed against said target for emitting fast neutrons from said target, comprising the step of:

enclosing said target in a neutron flux booster material having an inlet, said inlet having a size greater than the generator aperture and being positioned adjacent to the generator aperture to thereby surround the generator aperture, said booster further including a cavity formed therein for receiving the target, said cavity having an opening spaced apart from said booster inlet and being aligned with said booster inlet and further being aligned with said generator aperture, the target being positioned within said cavity and spaced apart from said cavity opening, said cavity having a depth substantially greater than the thickness of the target such that the booster completely encases the target except for the cavity opening facing the generator;

discharging ions from the neutron generator to the target through the inlet in the neutron flux booster thereby discharging a stream of fast neutrons produced at said target; and receiving high energy neutrons from the target into the neutron flux booster material to undergo collisions with said material to release additional high energy neutrons in said material.

10. The method of claim 9 further comprising the step of:

subjecting neutrons released from said material to a moderator medium whereby part of the energy of said neutrons is absorbed to obtain thermal neutrons.

11. The method of claim 9 wherein at least two streams of neutrons are discharged into said high neutron cross section material.

* * * * *